US011150579B2

(12) United States Patent
Abler et al.

(10) Patent No.: US 11,150,579 B2
(45) Date of Patent: Oct. 19, 2021

(54) GEAR ASSEMBLY FOR A REPLACEABLE UNIT OF AN ELECTROPHOTOGRAPHIC IMAGE FORMING DEVICE

(71) Applicant: LEXMARK INTERNATIONAL, INC., Lexington, KY (US)

(72) Inventors: Jeffrey Alan Abler, Georgetown, KY (US); Brian Lester Boettcher, Versailles, KY (US); Brian Lee Hawes, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/905,039

(22) Filed: Jun. 18, 2020

(65) Prior Publication Data

US 2021/0011397 A1 Jan. 14, 2021

Related U.S. Application Data

(60) Provisional application No. 62/872,354, filed on Jul. 10, 2019.

(51) Int. Cl.
*G03G 15/08* (2006.01)
*G03G 15/16* (2006.01)

(52) U.S. Cl.
CPC ..... *G03G 15/1615* (2013.01); *G03G 15/169* (2013.01); *G03G 2215/025* (2013.01); *G03G 2215/0872* (2013.01); *G03G 2215/1619* (2013.01)

(58) Field of Classification Search
CPC ..... G03G 15/1615; G03G 15/169; G03G 2215/0872; G03G 2215/025; G03G 2215/1619
See application file for complete search history.

(56) References Cited

U.S. PATENT DOCUMENTS

| | | | | |
|---|---|---|---|---|
| 10,474,093 | B1 | 11/2019 | Amann et al. | |
| 2005/0063733 | A1* | 3/2005 | Jeon | G03G 15/0896 399/167 |
| 2005/0111881 | A1* | 5/2005 | Arimitsu | G03G 15/0216 399/167 |
| 2012/0195634 | A1* | 8/2012 | Kuriki | G03G 15/0818 399/281 |
| 2018/0188682 | A1* | 7/2018 | Kim | G03G 21/1864 |
| 2021/0011422 | A1* | 1/2021 | Hawes | G03G 21/186 |

OTHER PUBLICATIONS

Declaration of Jeffrey Alan Abler (attached—7 pages).

* cited by examiner

*Primary Examiner* — G. M. A Hyder

(57) ABSTRACT

A toner cartridge according to one example embodiment includes a developer roll and a toner adder roll. First and second drive gears are rotatably connected to and coaxial with the developer roll and toner adder roll, respectively. The toner cartridge includes a drive coupler exposed to receive rotational motion when the toner cartridge is installed in an image forming device. Gear teeth of the first drive gear are directly meshed with gear teeth of the drive coupler of the toner cartridge. The second drive gear is rotatably connected to the drive coupler through a pair of idler gears.

10 Claims, 8 Drawing Sheets

GEAR ASSEMBLY FOR A REPLACEABLE UNIT OF AN ELECTROPHOTOGRAPHIC IMAGE FORMING DEVICE

CROSS REFERENCES TO RELATED APPLICATIONS

This application claims priority to U.S. Provisional Patent Application Ser. No. 62/872,354, filed Jul. 10, 2019, entitled "Gear Assembly for a Replaceable Unit of an Electrophotographic Image Forming Device," the content of which is hereby incorporated by reference in its entirety.

BACKGROUND

1. Field of the Disclosure

The present disclosure relates generally to image forming devices and more particularly to a gear assembly for a replaceable unit of an electrophotographic image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

Various imaging components, such as a developer roll and a photoconductive drum, are typically provided on one or more replaceable units permitting periodic replacement of the imaging components over the life of the image forming device. Each replaceable unit includes one or more drive couplers that mate with corresponding drive couplers in the image forming device to transfer rotational motion from a motor in the image forming device to rotatable imaging components of the replaceable units. In particular, rotational motion is often transferred from the drive coupler(s) on each replaceable unit to rotatable imaging components by way of one or more gear trains on the replaceable unit. Modulations in the angular velocity of the imaging components, which is often the result of error in the motion of one or more gears driving the imaging components, can cause print defects, such as the presence of horizontal bands on the printed page. It is desired to minimize the occurrence of such print defects.

SUMMARY

A toner cartridge for use in an electrophotographic image forming device according to one example embodiment includes a housing having a reservoir for holding toner. A toner adder roll is positioned on the housing and is rotatable about a first rotational axis. A developer roll is positioned on the housing and is rotatable about a second rotational axis. The toner adder roll is positioned to supply toner from the reservoir to the developer roll. The developer roll is positioned to supply toner received from the toner adder roll to a photoconductive drum. A drive coupler is rotatable about a third rotational axis. The drive coupler of the toner cartridge has a force receiving portion exposed on the housing to contact and receive rotational force from a corresponding drive coupler in the image forming device when the toner cartridge: is installed in the image forming device. The drive coupler of the toner cartridge includes gear teeth disposed around the third rotational axis. A first drive gear is rotatably connected to the developer roll and is coaxial with the developer roll. The first drive gear includes gear teeth disposed around the second rotational axis. The gear teeth of the first drive gear are directly meshed with the gear teeth of the drive coupler of the toner cartridge. A second drive gear is rotatably connected to the toner adder roll and is coaxial with the toner adder roll. The second drive gear includes gear teeth disposed around the first rotational axis. A first rotatable idler gear and a second rotatable idler gear each have respective gear teeth. The gear teeth of the first idler gear are directly meshed with the gear teeth of the drive coupler of the toner cartridge separate from the direct mesh between the gear teeth of the first drive gear and the gear teeth of the drive coupler of the toner cartridge. The gear teeth of the second idler gear are directly meshed with the gear teeth of the first idler gear and are directly meshed with the gear teeth of the second drive gear.

A toner cartridge for use in an electrophotographic image forming device according to another example embodiment includes a housing having a reservoir for holding toner. A toner adder roll is positioned on the housing and is rotatable about a first rotational axis. A developer roll is positioned on the housing and is rotatable about a second rotational axis. The toner adder roll is positioned to supply toner from the reservoir to the developer roll. The developer roll is positioned to supply toner received from the toner adder roll to a photoconductive drum. A drive coupler is rotatable about a third rotational axis. The drive coupler of the toner cartridge has a force receiving portion exposed on the housing to contact and receive rotational force from a corresponding drive coupler in the image forming device when the toner cartridge is installed in the image forming device. The drive coupler of the toner cartridge includes gear teeth disposed around the third rotational axis. A first drive gear is rotatably connected to the developer roll and is coaxial with the developer roll. The first drive to gear includes gear teeth disposed around the second rotational axis. The gear teeth of the first drive gear are directly meshed with the gear teeth of the drive coupler of the toner cartridge. A second drive gear is rotatably connected to the toner adder roll and is coaxial with the toner adder roll. The second drive gear includes gear teeth disposed around the first rotational axis. A first idler gear is rotatable about a fourth rotational axis. The first idler gear includes gear teeth disposed around the fourth rotational axis. A second idler gear is rotatable about a fifth rotational axis. The second idler gear includes gear teeth disposed around the fifth rotational axis. The gear teeth of the first idler gear are directly meshed with the gear teeth of the drive coupler of the toner cartridge. The gear teeth of the second idler gear are directly meshed with the gear teeth of the second drive gear. The second idler gear is rotatably connected to the first idler gear. The first, second, third, fourth and fifth rotational axes are all radially offset from each other.

A toner cartridge for use in an electrophotographic image forming device according to another example embodiment includes a housing having a top, a bottom, a first side and a second side positioned between a first longitudinal end and a second longitudinal end of the housing. The housing has a reservoir for holding toner. A photoconductive drum is rotatably positioned on the housing. A portion of an outer surface of the photoconductive drum is exposed along the bottom of the housing. A toner adder roll is positioned on the housing and is rotatable about a first rotational axis. A developer roll is positioned on the housing and rotatable about a second rotational axis. The toner adder roll is positioned to supply toner from the reservoir to the developer roll. The developer roll is positioned to supply toner received from the toner adder roll to the photoconductive drum. A first drive coupler and a second drive coupler on the first longitudinal end of the housing are positioned for mating with a first corresponding drive coupler in the image forming device and a second corresponding drive coupler in the image forming device for receiving rotational motion from the first corresponding drive coupler in the image forming device and the second corresponding drive coupler in the image forming device when the toner cartridge is installed in the image forming device. The first drive coupler of the toner cartridge is rotatably connected to the photoconductive drum and is coaxial with the photoconductive drum. The second drive coupler of the toner cartridge has a third rotational axis. The second drive coupler of the toner cartridge includes a first set of gear teeth and a second set of gear teeth disposed around the third rotational axis. An outer radius of the first set of gear teeth is greater than an outer radius of the second set of gear teeth. The second drive coupler of the toner cartridge is positioned higher than the developer roll and the photoconductive drum. A first drive gear is rotatably connected to the developer roll and is coaxial with the developer roll. The first drive gear is positioned on the first longitudinal end of the housing. The first drive gear includes gear teeth disposed around the second rotational axis. The gear teeth of the first drive gear are directly meshed with the first set of gear teeth of the second drive coupler of the toner cartridge. A second drive gear is rotatably connected to the toner adder roll and is coaxial with the toner adder roll. The second drive gear is positioned on the first longitudinal end of the housing. The second drive gear includes gear teeth disposed around the first rotational axis. A first idler gear and a second idler gear are each rotatably positioned on the first longitudinal end of the housing and each have respective gear teeth. The gear teeth of the first idler gear are directly meshed with the second set of gear teeth of the second drive coupler of the toner cartridge. The gear teeth of the second idler gear are directly meshed with the gear teeth of the first idler gear and are directly meshed with the gear teeth of the second drive gear.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
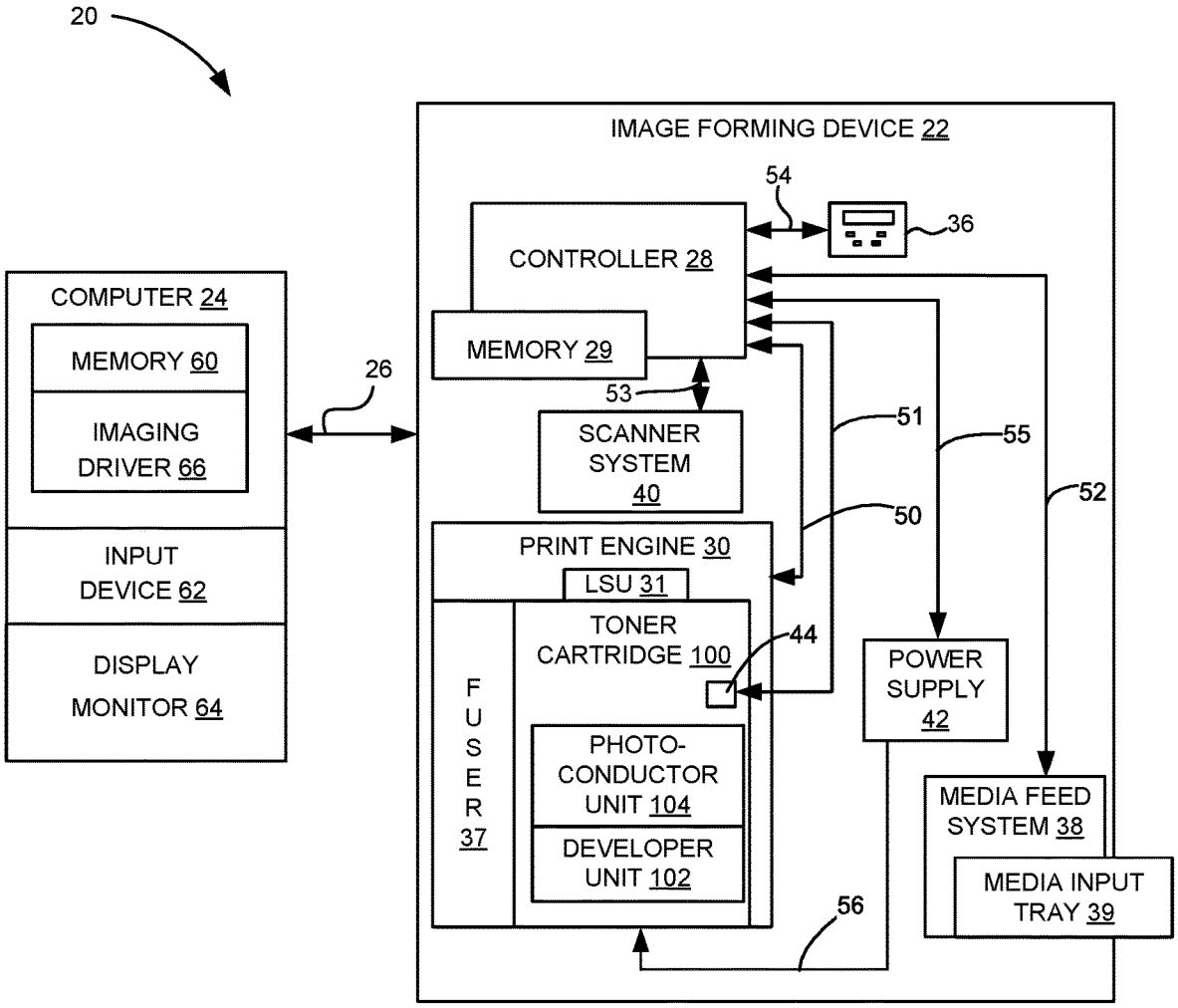
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24, Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIC) device) that includes a controller 28, a print engine 30, a laser scan unit (LSU) 31, a toner cartridge 100, a user interface 36, a media feed system 38, a media input tray 39, a scanner system 40 and a power supply 42. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor unit may include one or more integrated circuits in the form of a microprocessor or central processing unit and may include one or more Application-Specific Integrated Circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with media feed system 38 via a communications link 52. Controller 28 communicates with scanner system 40 via a communications link 53. User interface 36 is communicatively coupled to controller 28 via a communications link 54. Controller 28 communicates with power supply 42 via a communications link 55. Controller 28 processes print and scan data and operates print engine 30 during printing and scanner system 40 during scanning. Processing circuitry 44 may provide authentication functions, safety and operational interlocks, operating parameters and usage information related to toner cartridge 100. Processing circuitry 44 includes a processor unit and associated electronic memory. As discussed above, the processor may include one or more integrated circuits in the form of a microprocessor or central processing unit and/or may include one or more Application-Specific Integrated Circuits (ASICs). The memory may be any volatile or non-volatile memory or combination thereof or any memory device convenient for use with processing circuitry 44.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 100 and a fuser 37, all mounted within image forming device 22. Toner cartridge 100 is removably mounted in image forming device 22. Power supply 42 provides an electrical voltage to various components of toner cartridge 100 via an electrical path 56. Toner cartridge 100 includes a developer unit 102 that houses a toner reservoir and a toner development system. In the example embodiment illustrated, the toner development system utilizes what is commonly referred to as a single component development system. In this embodiment, the toner development system includes a toner adder roll that provides toner from the toner reservoir to a developer roll. A doctor blade provides a metered, uniform layer of toner on the surface of the developer roll. Toner cartridge 100 also includes a photoconductor unit 104 that houses a charge roll, a photoconductive drum and a waste toner removal system. Although the example image forming device 22 illustrated in FIG. 1 includes one toner cartridge, in the case of an image forming device configured to print in color, separate toner cartridges may be used for each toner color. For example, in one embodiment, the image forming device includes four toner cartridges, each toner cartridge containing a particular toner color (e.g., black, cyan, yellow and magenta) to permit color printing.

Figure 2:
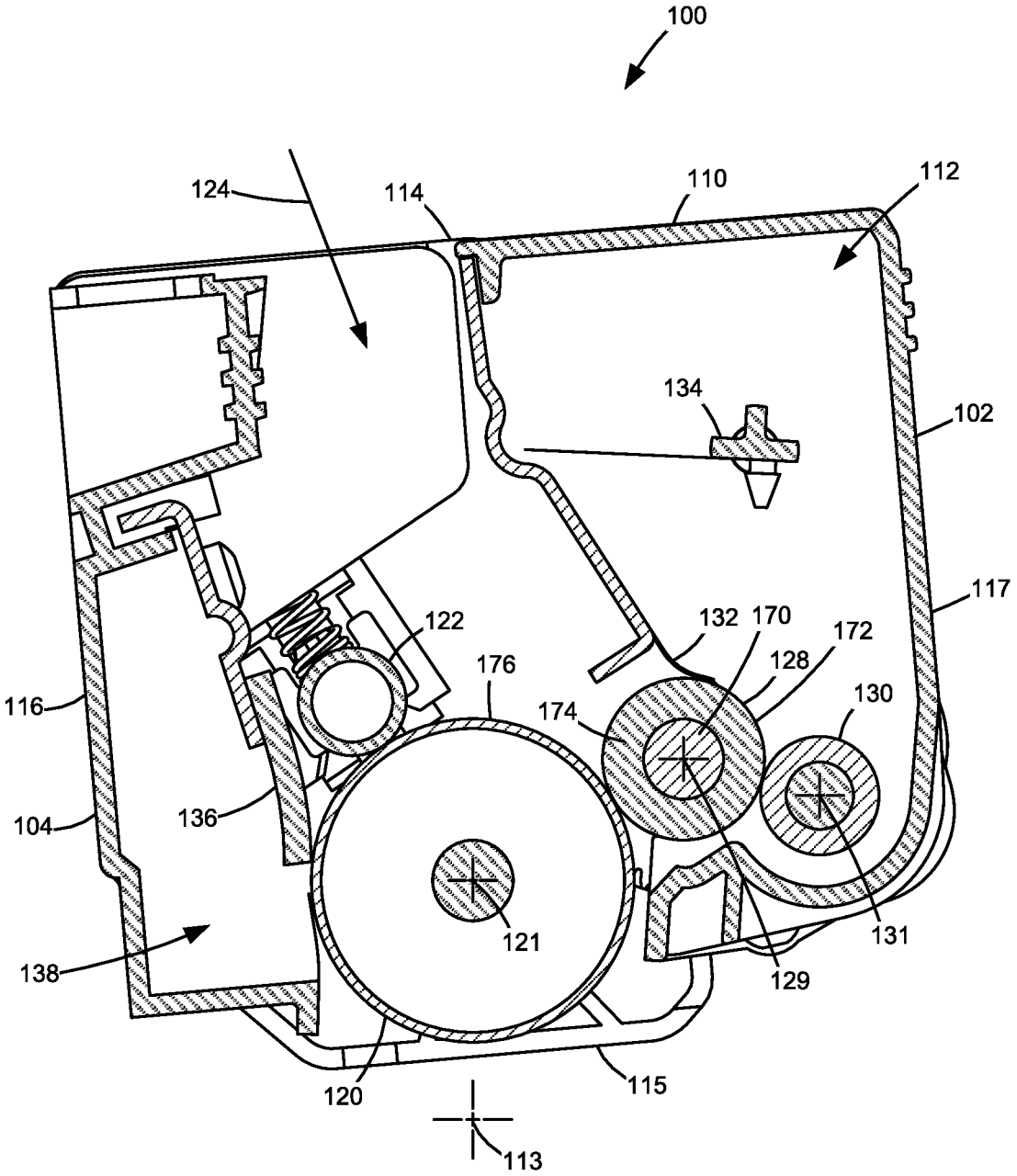
FIG. 2 is a cross-sectional view of a toner cartridge of the imaging system according to one example embodiment.

FIG. 2 shows toner cartridge 100 according to one example embodiment. Toner cartridge 100 includes an elongated housing 110 that includes walls forming a toner reservoir 112. Housing 110 generally includes various elements that form the overall body and support structure of toner cartridge 100 including, for example, a main body portion, end caps, lids, gear plates, etc. In the example embodiment illustrated, housing 110 extends along a longitudinal dimension 113 and includes a top 114, a bottom 115, a side 116 and a side 117 that extend between longitudinal ends 118, 119 (FIGS. 3 and 4) of housing 110. In this embodiment, developer unit 102 is positioned along side 117 of housing 110 and photoconductor unit 104 is positioned along side 116 of housing 110.

The electrophotographic printing process is well known in the art and, therefore, is described briefly herein. During a print operation, a rotatable charge roll 122 of photoconductor unit 104 charges the surface of a rotatable photoconductive drum 120. The charged surface of photoconductive drum 120 is then selectively exposed to a laser light source 124 from LSU 31 through a slit 126 (FIG. 4) in the top 114 of housing 110 to form an electrostatic latent image on photoconductive drum 120 corresponding to the image to be printed. Charged toner from developer unit 102 is picked up by the latent image on photoconductive drum 120 creating a toned image on the surface of photoconductive drum 120. Charge roll 122 and photoconductive drum 120 are each electrically charged to a respective predetermined voltage by power supply 42 in order to achieve a desired voltage differential between the charged portions of the surface of photoconductive drum 120 and the portions of the surface of photoconductive drum 120 discharged by laser light source 124.

Developer unit 102 includes toner reservoir 112 having toner stored therein and a rotatable developer roll 128 that supplies toner from toner reservoir 112 to photoconductive drum 120. In the example embodiment illustrated, a rotatable toner adder roll 130 in developer unit 102 supplies toner from toner reservoir 112 to developer roll 128. A doctor blade 132 disposed along developer roll 128 provides a substantially uniform layer of toner on developer roll 128 for transfer to photoconductive drum 120. As developer roll 128 and photoconductive drum 120 rotate, toner particles are electrostatically transferred from developer roll 128 to the latent image on photoconductive drum 120 forming a toned image on the surface of photoconductive drum 120. In one embodiment, developer roll 128 and photoconductive drum 120 rotate in opposite rotational directions such that their adjacent surfaces move in the same direction to facilitate the transfer of toner from developer roll 128 to photoconductive drum 120. One or more movable toner agitators 134 may be provided in toner reservoir 112 to distribute the toner therein and to break up any clumped toner. Developer roll 128 and toner adder roll 130 are each electrically charged to a respective predetermined voltage by power supply 42 in order to attract toner from reservoir 112 to toner adder roll 130 and to electrostatically transfer toner from toner adder roll 130 to developer roll 128 and from developer roll 128 to the latent image on the surface of photoconductive drum 120. Doctor blade 132 may also be electrically charged to a predetermined voltage by power supply 42 as desired.

The toned image is then transferred from photoconductive drum 120 to the print media (e.g., paper) either directly by photoconductive drum 120 or indirectly by an intermediate transfer member. In the example embodiment illustrated, the surface of photoconductive drum 120 is exposed from housing 110 along the bottom 115 of housing 110 where the toned image transfers from photoconductive drum 120 to the print media or intermediate transfer member. Fuser 37 (FIG. 1) then fuses the toner to the print media. A cleaner blade 136 (or cleaner roll) of photoconductor unit 104 removes any residual toner adhering to photoconductive drum 120 after the toner is transferred from photoconductive drum 120 to the print media or intermediate transfer member. Waste toner from cleaner blade 136 may be held in a waste toner reservoir 138 in photoconductor unit 104 as illustrated or moved to a separate waste toner container. The cleaned surface of photoconductive drum 120 is then ready to be charged again and exposed to laser light source 124 to continue the printing cycle.

Figure 3:
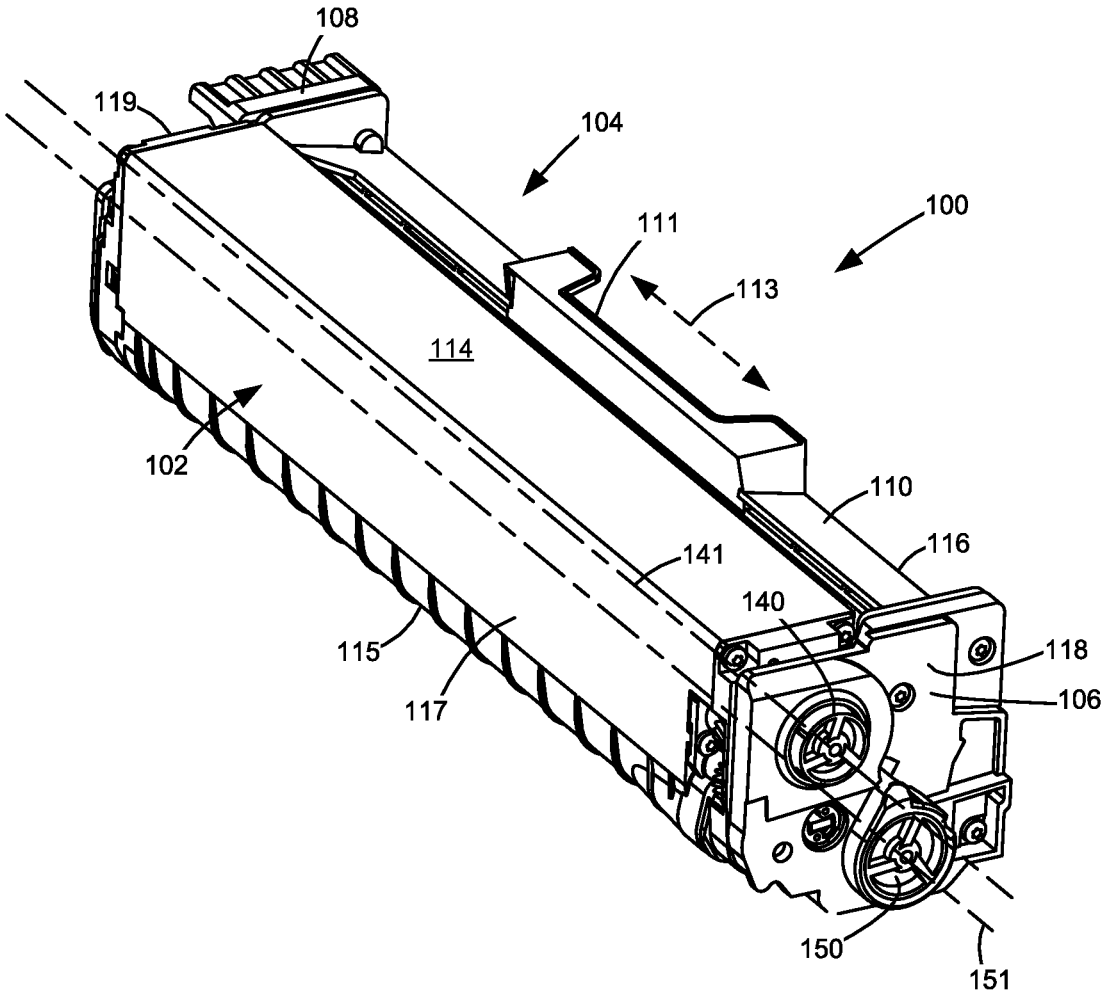
FIGS. 3 and 4 are perspective views of the toner cartridge according to one example embodiment.
Figure 4:
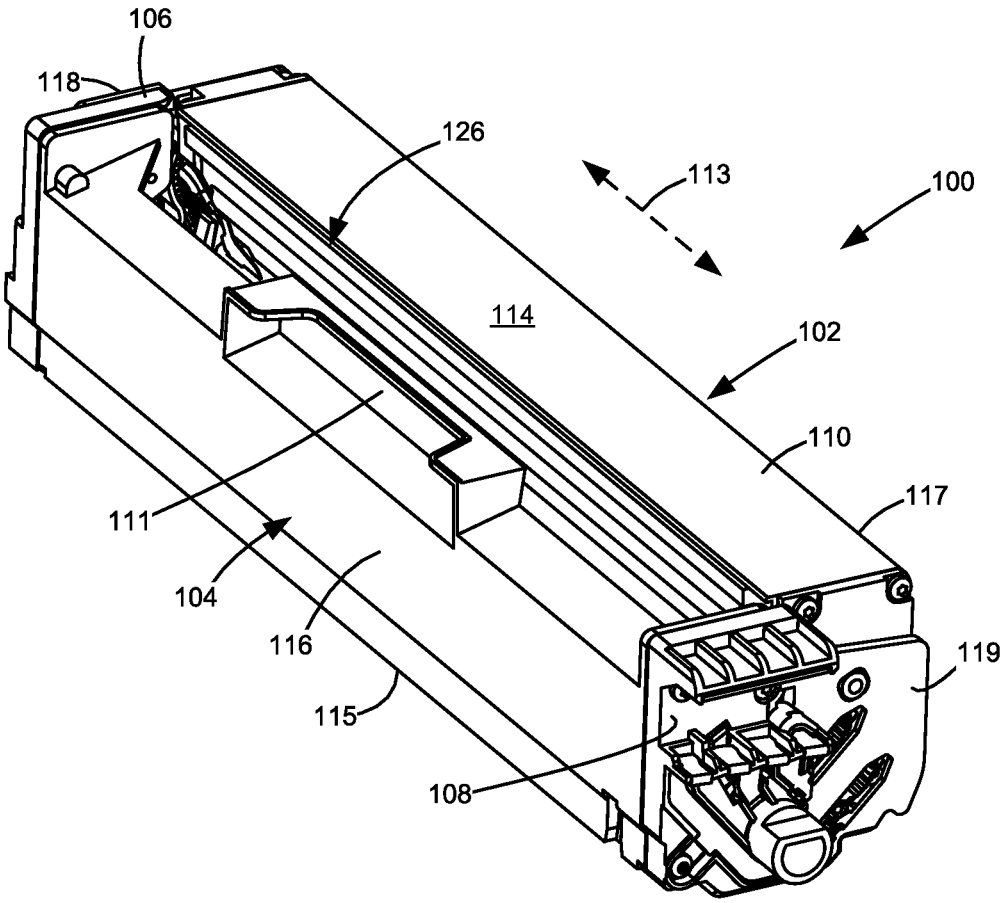
Figure 5:
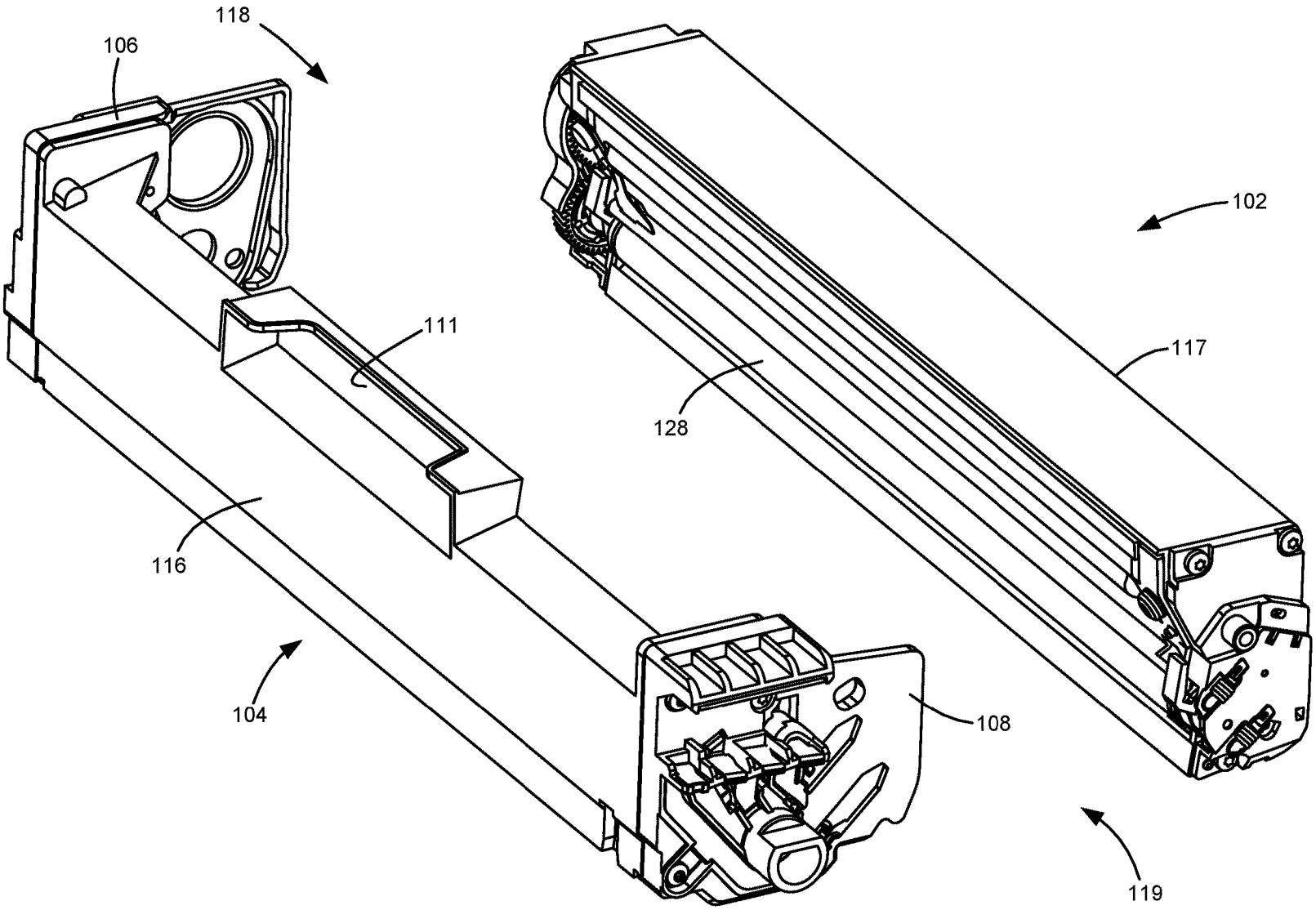
FIG. 5 is an exploded view of the toner cartridge shown in FIGS. 3 and 4 showing a developer unit and a photoconductor unit of the toner cartridge according to one example embodiment.

FIGS. 3-5 show the exterior of toner cartridge 100 according to one example embodiment. As shown, in this embodiment, developer unit 102 is positioned at side 117 of housing 110 and photoconductor unit 104 is positioned at side 116 of housing 110. FIG. 5 shows developer unit 102 separated from photoconductor unit 104 with developer roll 128 exposed on developer unit 102 for mating with photoconductive drum 120. In the example embodiment illustrated, toner cartridge 100 includes a handle 111 positioned along side 116 and/or top 114 of housing 110 to assist the user with handling toner cartridge 100.

Figure 6:
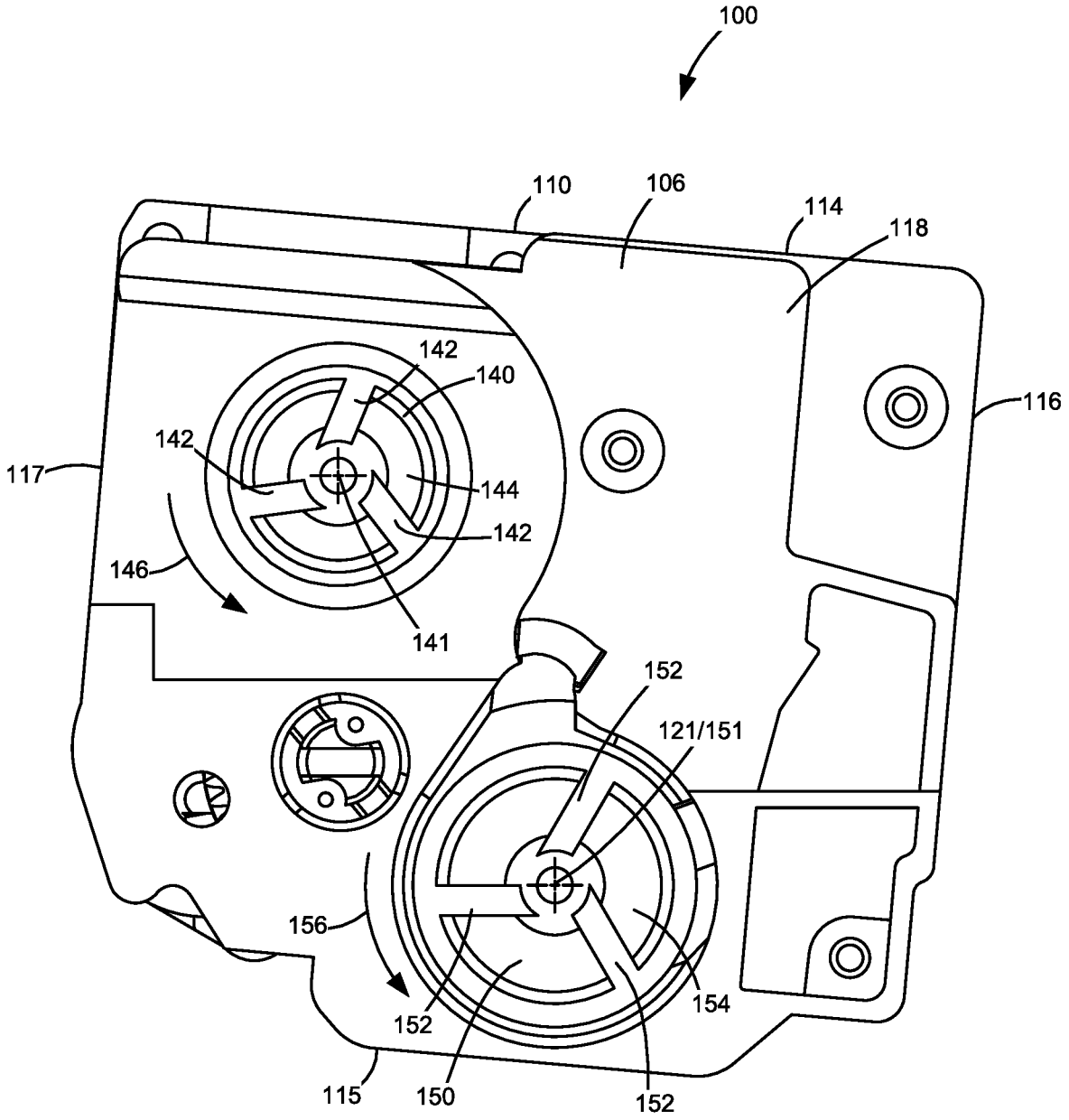
FIG. 6 is an elevation view of a first longitudinal end of the toner cartridge of FIGS. 3-5 according to one example embodiment.

With reference to FIGS. 3 and 6, in the example embodiment illustrated, a pair of interface drive couplers 140, 150 are exposed on an outer portion of housing 110 in position to receive rotational force from a corresponding drive system in image forming device 22 when toner cartridge 100 is installed in image forming device 22 to drive rotatable components of developer unit 102 and photoconductive drum 120, respectively. The drive system in image forming device 22 includes one or more drive motors and a drive transmission from the drive motor(s) to a pair of drive couplers that mate with drive couplers 140, 150 of toner cartridge 100 when toner cartridge 100 is installed in image forming device 22. In the example embodiment illustrated, drive couplers 140, 150 are each exposed on end 118 of housing 110. Each drive coupler 140, 150 includes a rotational axis 141, 151. Each drive coupler 140, 150 includes a force receiving portion that mates with and receives rotational motion from the corresponding drive couplers in image forming device 22 as discussed in greater detail below. Drive coupler 140 is operatively connected (either directly or indirectly through one or more intermediate gears) to rotatable components of developer unit 102 including, for example, developer roll 128, toner adder roll 130 and toner agitator 134, to rotate developer roll 128, toner adder roll 130 and toner agitator 134 upon receiving rotational force from the corresponding drive system in image forming device 22. Drive coupler 150 is operatively connected (either directly as in the embodiment illustrated or indirectly through one or more intermediate gears) to photoconductive drum 120 to rotate photoconductive drum 120 upon receiving rotational force from the corresponding drive system in image forming device 22. In some embodiments, charge roll 122 is driven by friction contact between the surfaces of charge roll 122 and photoconductive drum 120. In other embodiments, charge roll 122 is connected to drive coupler 150 by one or more gears.

In the embodiment illustrated, each drive coupler 140, 150 includes lugs 142, 152 positioned on an outer axial end 144, 154 of the drive coupler 140, 150 and that are spaced circumferentially around the rotational axis 141, 151 of the drive coupler 140, 150. In this embodiment, lugs 142, 152 each contact corresponding drive lugs on the corresponding drive coupler in image forming device 22 permitting the use of corresponding drive couplers in image forming device 22 that are substantially coaxial with drive couplers 140, 150. In operation, drive couplers 140, 150 are driven in respective operative rotational directions 146, 156 by the to corresponding drive couplers in image forming device 22. While the example embodiment illustrated includes lugs 142, 152 positioned on an outer axial end 144, 154 of each drive coupler 140, 150, in other embodiments, one or both of drive couplers 140, 150 may include gear teeth that mesh with and receive rotational force from corresponding gear teeth on the corresponding drive coupler in image forming device 22 when toner cartridge 100 is installed in image forming device 22.

Figure 7:
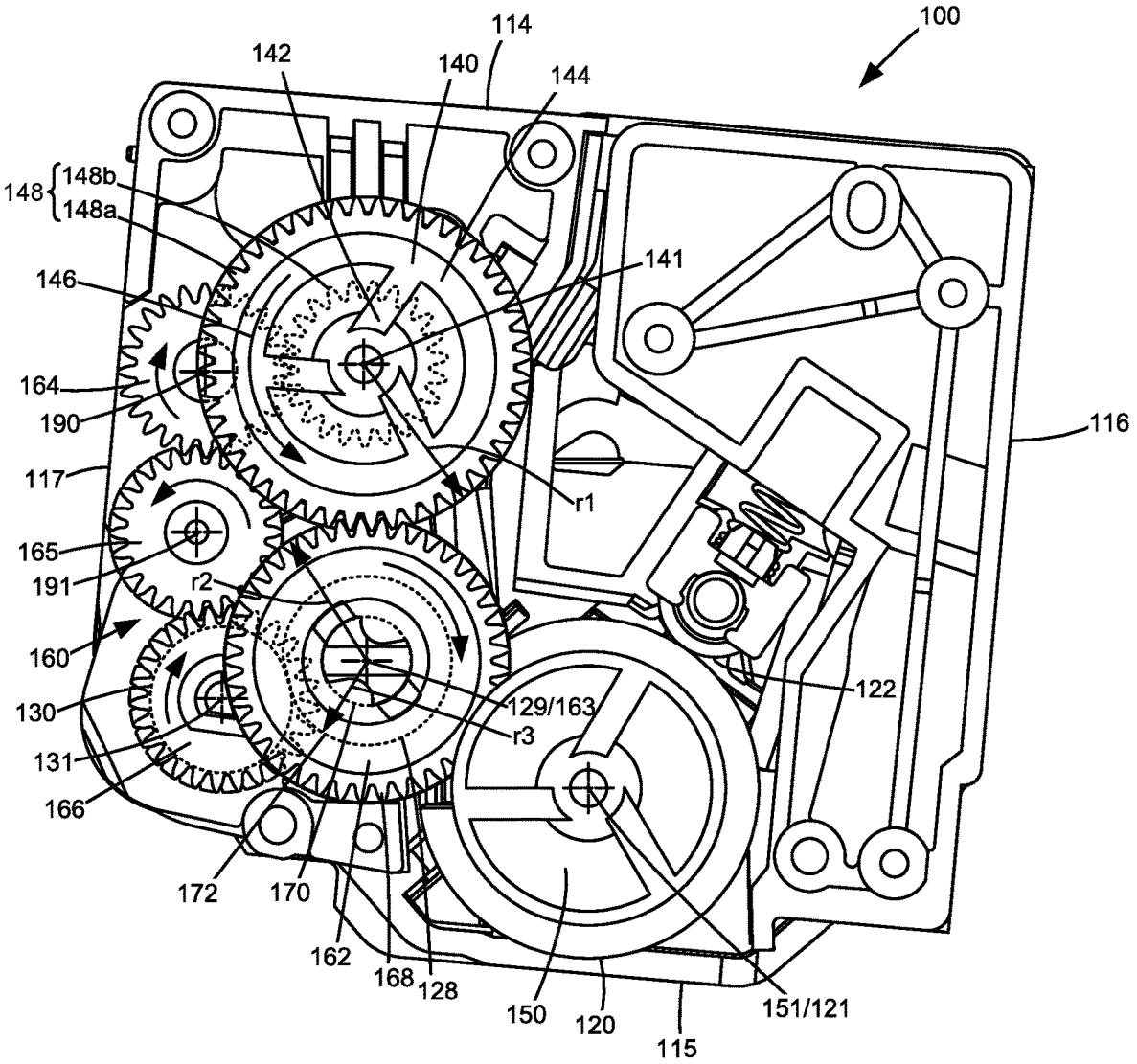
FIG. 7 is an elevation view of the first longitudinal end of the toner cartridge with an end cap omitted to show a gear train on the first longitudinal end of the toner cartridge according to one example embodiment.

FIG. 7 shows end 118 of housing 110 with an end cap 106 (FIG. 3) omitted to show a gear train 160 positioned on end 118 of housing 110 behind end cap 106 according to one example embodiment. Portions of some components obscured behind other components as viewed in FIG. 7 are shown in broken line in order to aid the description of gear train 160. In the example embodiment illustrated, gear train 160 transfers rotational motion received by drive coupler 140 to developer roll 128 and to toner adder roll 130 in order to rotate developer roll 128 and toner adder roll 130.

Drive coupler 140 includes one or more sets of gear teeth 148 that mesh with corresponding gears of drive train 160. In the embodiment illustrated, drive coupler 140 includes two sets of gear teeth 148*a*, 148*b* forming a compound gear suitable for simultaneously transmitting rotational motion to a pair of corresponding gears. In this embodiment, gear teeth 148*b* are positioned axially inward (i.e., farther from outer axial end 144) from gear teeth 148*a* and have a smaller radius than gear teeth 148*a*; however, many configurations of gear teeth 148 are possible. As desired, drive coupler 140 may be formed as a single component or as multiple components coupled coaxially to each other. For example, in one embodiment, drive coupler 140 includes lugs 142 formed on a first component and gear teeth 148 formed on a second component that is coupled to and coaxial with the first component.

In the embodiment illustrated, gear teeth 148*a* of drive coupler 140 mesh directly with a drive gear 162 that is coupled to and coaxial with a shaft 170 of developer roll 128 in order to transfer rotational motion from drive coupler 140 to developer roll 128 when drive coupler 140 rotates in operative rotational direction 146. Outer radii r1 and r2 of gear teeth 148*a* of drive coupler 140 and gear teeth 168 of drive gear 162 are larger than a radius r3 of an outer surface 172 of an elastomeric roll portion 174 (FIG. 2) of developer roll 128 that contacts an outer surface 176 (FIG. 2) of photoconductive drum 120. In some embodiments, outer radii r1 and r2 of gear teeth 148*a* of drive coupler 140 and gear teeth 168 of drive gear 162 are at least 20% larger, i.e., at least 1.2 times as large, and, in some instances, at least 50% larger, i.e., at least 1.5 times as large, than the radius r3 of outer surface 172 of elastomeric roll portion 174 of developer roll 128.

The relatively large radii r1 and r2 of gear teeth 148*a* of drive coupler 140 and, particularly, gear teeth 168 of drive gear 162 help significantly reduce angular error in the motion of gear teeth 148*a* and drive gear 162. Larger gears reduce angular motion error for two reasons. First, for a given torque load on a gear (such as drive coupler 140 or drive gear 162), the load on the gear teeth (such as gear teeth 148*a* or 168) is inversely proportional to the radius of the gear teeth from the rotational axis of the gear such that gear teeth of a large gear deflect less than gear teeth of a small gear under the same load on the gear. Second, for a given amount of deflection of a gear tooth (such as gear teeth 148*a* or 168), the angular motion error is inversely proportional to the radius of the gear teeth from the rotational axis of the gear such that tooth deflection on a larger gear results in less angular error than the same amount of tooth deflection on a smaller gear. Combining these two effects, angular error due to tooth deflection decreases with the square of the radius of the gear teeth.

In the embodiment illustrated, drive coupler 140 is positioned closer to top 114 of housing 110 than to bottom 115 of housing 110 and closer to side 117 of housing 110 than to side 116 of housing 110. Drive coupler 140 is positioned higher than photoconductive drum 120, developer roll 128 and toner adder roll 130 and is positioned closer to side 117 of housing 110 than photoconductive drum 120 is to side 117 of housing 110). In the embodiment illustrated, drive gear 162 and developer roll 128 are positioned closer to bottom 115 of housing 110 than to top 114 of housing 110 and closer to side 117 of housing 110 than to side 116 of housing 110. A rotational axis 129 of developer roll 128 and a rotational axis 163 of drive gear 162 are positioned higher than a rotational axis 121 of photoconductive drum 120 and rotational axis 151 of drive coupler 150 and are positioned lower than rotational axis 141 of drive coupler 140. Rotational axis 129 of developer roll 128 and rotational axis 163 of drive gear 162 are also positioned closer to side 117 of housing 110 than rotational axis 121 of photoconductive drum 120 and rotational axis 151 of drive coupler 150 are to side 117 of housing 110. In this embodiment, a rotational axis 131 of toner adder roll 130 is positioned closer to side 117 of housing 110 than rotational axes 141, 129 and 163 of drive coupler 140, developer roll 128 and drive gear 162 are to side 117 of housing 110.

The relative positioning of these components, such as the positioning of drive coupler 140 relative to photoconductive drum 120, developer roll 128 and toner adder roll 130, permits the use of a drive gear 162 and gear teeth 148*a* of drive coupler 140 having relatively large diameters and permits direct mesh between gear teeth 168 of drive gear 162 and gear teeth 148*a* of drive coupler 148. Further, in the embodiment illustrated, developer unit 102 is pivotable relative to photoconductor unit 104 about a pivot axis that is defined at end 118 of housing 110 by the position of rotational axis 141 of drive coupler 140. In this embodiment, the rotational motion of drive coupler 140 when drive coupler 140 rotates in operative rotational direction 146 applies a moment on developer unit 102 in a counterclockwise direction as viewed in FIG. 7 to urge developer roll 128 against photoconductive drum 120. The positioning of drive coupler 140 relative to photoconductive drum 120 and developer roll 128 allows the rotation of drive coupler 140 to provide sufficient nip force between developer roll 128 and photoconductive drum 120 to maintain contact between developer roll 128 and photoconductive drum 120 during operation.

In the embodiment illustrated, gear teeth 148*b* of drive coupler 140 mesh with a first idler gear 164 (having a rotational axis 190) that, in turn, meshes with a second idler gear 165 (having a rotational axis 191) that meshes with a drive gear 166. Drive gear 166 is coupled to and coaxial with a shaft of toner adder roll 130 in order to transfer rotational motion from drive coupler 140 to toner adder roll 130 when drive coupler 140 rotates in operative rotational direction 146. In this embodiment, idler gears 164, 165 and drive gear 166 are positioned axially inboard of gear teeth 148*a* of drive coupler 140 and axially inboard of drive gear 162. In some embodiments, idler gear 164 has the same diameter as idler gear 165 in order to maximize the size of both idler gears 164, 165 (since increasing the size of one idler gear 164 or 165 may necessarily require decreasing the size of the other idler gear 164 or 165 due to space constraints) to help reduce the occurrence of angular error of idler gears 164, 165.

In the embodiment illustrated, drive gear 166 is positioned axially inboard of drive gear 162 and axially outboard of elastomeric roll portion 174 of developer roll 128. This allows drive gear 166 to extend within the radius of drive gear 162 (axially between drive gear 162 and elastomeric roll portion 174 of developer roll 128) with the size of drive gear 166 limited instead by the distance from rotational axis 131 of toner adder roll 130 to an outer surface of shaft 170 of developer roll 128 to help reduce the occurrence of angular error of drive gear 166.

The use of an even number of idler gears 164, 165 between drive coupler 140 and drive gear 166 causes toner adder roll 130 to rotate in the same direction as developer roll 128, which is preferred for toner transfer from toner adder roll 130 to developer roll 128, where drive gear 162 of developer roll 128 meshes directly with drive coupler 140. Further, the use of idler gears 164, 165 to rotate drive gear 166 of toner adder roll 130 provides greater positional freedom for locating toner adder roll 130 relative to developer roll 128, for example, to achieve a desired force balance. The use of idler gears 164, 165 to rotate drive gear 166 of toner adder roll 130 also provides greater freedom in the selection of sizes of gear teeth 148*b* of drive coupler 140 and the teeth of drive gear 166, for example, to reduce the rotational speed of toner adder roll 130 relative to developer roll 128. It has been found that toner adder roll 130 can supply a sufficient amount of toner to developer roll 128 even at a slower rotational speed than developer roll 128 and that the slower rotational speed of toner adder roll 130 reduces toner working and power consumption. The slower rotational speed of toner adder roll 130 also helps reduce the stress on the teeth of drive gear 166, further reducing the occurrence of angular error of drive gear 166. Further, transferring rotational motion from drive coupler 140 to drive gear 166 of toner adder roll 130 through idler gears 164, 165 reduces torque disturbances on developer roll 128 from toner adder roll 130, which may cause print defects, in comparison with transferring rotational motion from drive coupler 140 to drive gear 166 of toner adder roll 130 through drive gear 162 of developer roll 128.

While the example embodiment illustrated includes drive gear 162 of developer roll 128 meshed directly with gear teeth 148*a* of drive coupler 140 and drive gear 166 of toner adder roll 130 connected to drive coupler 140 via two idler gears 164, 165, this configuration may be reversed as desired such that toner adder roll 130 is connected directly to drive coupler 140 and developer roll 128 is connected to drive coupler 140 via, one or more idler gears depending on the desired speed and direction of rotation of developer roll 128 relative to toner adder roll 130. However, print quality tends to be more sensitive to modulations in the angular motion of developer roll 128 than modulations in the angular motion of toner adder roll 130 such that it may be preferable to connect developer roll 128 directly to drive coupler 140 rather than connecting toner adder roll 130 directly to drive coupler 140.

Figure 8:
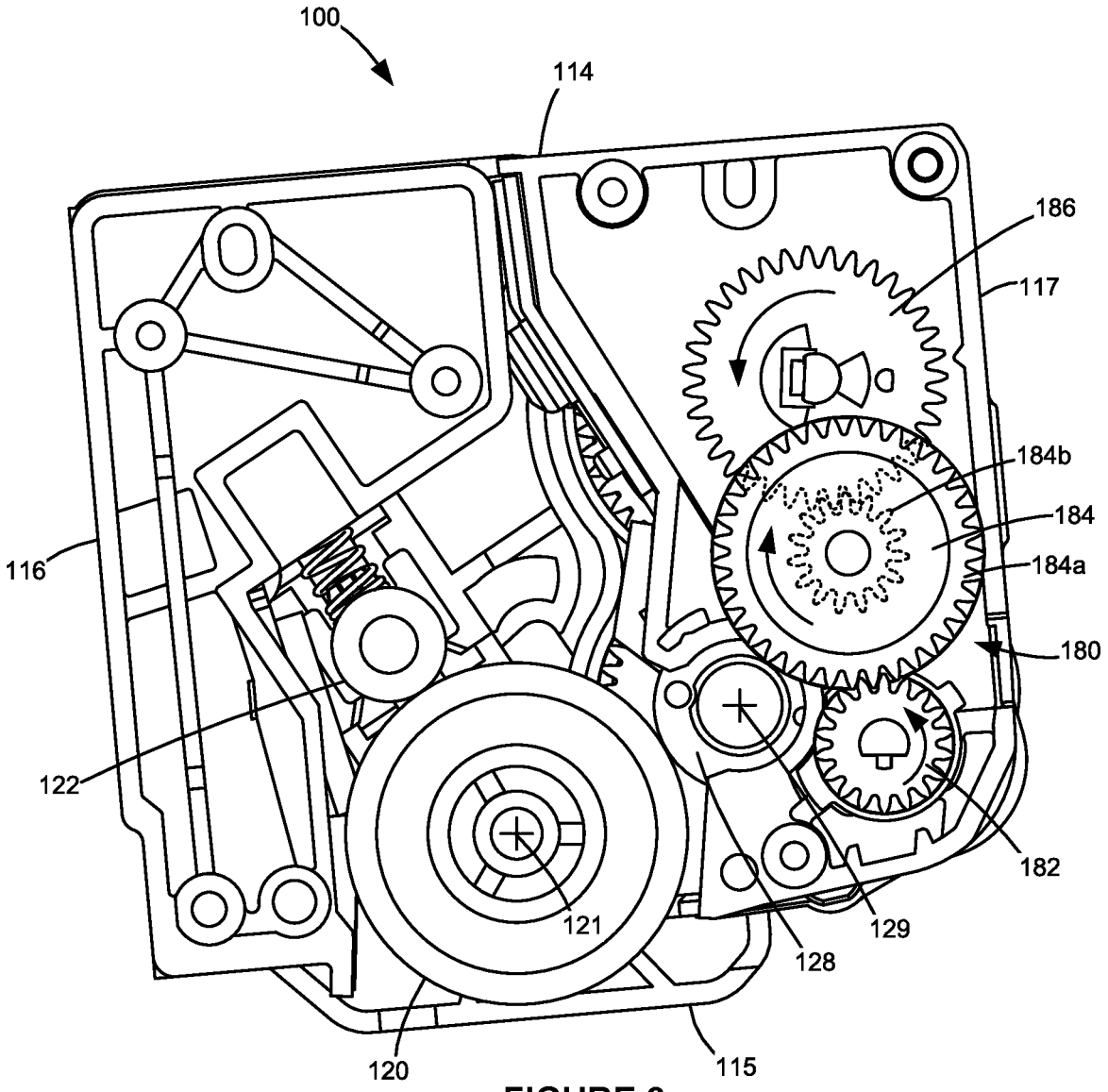
FIG. 8 is an elevation view of a second longitudinal end of the toner cartridge with an end cap omitted to show a gear train on the second longitudinal end of the toner cartridge according to one example embodiment.

FIG. 8 shows end 119 of housing 110 with an end cap 108 (FIG. 4) omitted to show a gear train 180 positioned on end 119 of housing 110 behind end cap 108 according to one example embodiment. In the example embodiment illustrated, gear train 180 transfers rotational motion from toner adder roll 130 to toner agitator 134 in order to rotate toner agitator 134. In this embodiment, a drive gear 182 that is coupled to and coaxial with the shaft of toner adder roll 130 meshes with gear teeth 184*a* of a compound idler gear 184. Gear teeth 184*b* of compound idler gear 184, in turn, mesh with a drive gear 186 that is coupled to a shaft of toner agitator 134 in order to transfer rotational motion received by toner adder roll 130 from drive coupler 140 to toner agitator 134 when drive coupler 140 rotates in operative rotational direction 146.

Although the example embodiment illustrated includes a single replaceable unit in the form of toner cartridge 100 for each toner color, it will be appreciated that the replaceable unit(s) of the image forming device may employ any suitable configuration as desired. For example, in another embodiment, the main toner supply for the image forming device is provided in a first replaceable unit and the developer unit and photoconductor unit are provided in a second replaceable unit. Other configurations may be used as desired.

Further, it will be appreciated that the architecture and shape of toner cartridge 100 illustrated in FIGS. 2-5 is merely intended to serve as an example. Those skilled in the art understand that toner cartridges, and other toner containers, may take many different shapes and configurations. Those skilled in the art will also appreciate that positional relationships described herein (e.g., above, below, top, bottom, etc.) refer to operative positions of the image forming device and its components.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A toner cartridge for use in an electrophotographic image forming device, comprising:

a housing having a reservoir for holding toner;

a toner adder roll positioned on the housing and rotatable about a first rotational axis;

a developer roll positioned on the housing and rotatable about a second rotational axis, the toner adder roll is positioned to supply toner from the reservoir to the developer roll, the developer roll is positioned to supply toner received from the toner adder roll to a photoconductive drum;

a drive coupler rotatable about a third rotational axis, the drive coupler of the toner cartridge has a force receiving portion exposed on the housing to contact and receive rotational force from a corresponding drive coupler in the image forming device when the toner cartridge is installed in the image forming device, the drive coupler of the toner cartridge includes gear teeth disposed around the third rotational axis;

a first drive gear rotatably connected to the developer roll and coaxial with the developer roll, the first drive gear includes gear teeth disposed around the second rotational axis, the gear teeth of the first drive gear are directly meshed with the gear teeth of the drive coupler of the toner cartridge;

a second drive gear rotatably connected to the toner adder roll and coaxial with the toner adder roll, the second drive gear includes gear teeth disposed around the first rotational axis; and a first rotatable idler gear and a second rotatable idler gear each having respective gear teeth, the gear teeth of the first idler gear are directly meshed with the gear teeth of the drive coupler of the toner cartridge separate from the direct mesh between the gear teeth of the first drive gear and the gear teeth of the drive coupler of the toner cartridge, the gear teeth of the second idler gear are directly meshed with the gear teeth of the first idler gear and are directly meshed with the gear teeth of the second drive gear.

2. The toner cartridge of claim 1, wherein the drive coupler of the toner cartridge includes a first set of gear teeth and a second set of gear teeth, the gear teeth of the first drive gear are directly meshed with the first set of gear teeth of the drive coupler of the toner cartridge, and the gear teeth of the first idler gear are directly meshed with the second set of gear teeth of the drive coupler of the toner cartridge.

3. The toner cartridge of claim 2, wherein an outer radius of the first set of gear teeth is greater than an outer radius of the second set of gear teeth.

4. The toner cartridge of claim 2, wherein the second set of gear teeth is positioned axially inward relative to the housing from the first set of gear teeth.

5. A toner cartridge for use in an electrophotographic image forming device, comprising:

a housing having a reservoir for holding toner;

a toner adder roll positioned on the housing and rotatable about a first rotational axis;

a developer roll positioned on the housing and rotatable about a second rotational axis, the toner adder roll is positioned to supply toner from the reservoir to the developer roll, the developer roll is positioned to supply toner received from the toner adder roll to a photoconductive drum;

a drive coupler rotatable about a third rotational axis, the drive coupler of the toner cartridge has a force receiving portion exposed on the housing to contact and receive rotational force from a corresponding drive coupler in the image forming device when the toner cartridge is installed in the image forming device, the drive coupler of the toner cartridge includes gear teeth disposed around the third rotational axis;

a first drive gear rotatably connected to the developer roll and coaxial with the developer roll, the first drive gear includes gear teeth disposed around the second rotational axis, the gear teeth of the first drive gear are directly meshed with the gear teeth of the drive coupler of the toner cartridge;

a second drive gear rotatably connected to the toner adder roll and coaxial with the toner adder roll, the second drive gear includes gear teeth disposed around the first rotational axis;

a first idler gear rotatable about a fourth rotational axis, the first idler gear includes gear teeth disposed around the fourth rotational axis; and a second idler gear rotatable about a fifth rotational axis, the second idler gear includes gear teeth disposed around the fifth rotational axis, wherein the gear teeth of the first idler gear are directly meshed with the gear teeth of the drive coupler of the toner cartridge, the gear teeth of the second idler gear are directly meshed with the gear teeth of the second drive gear, and the second idler gear is rotatably connected to the first idler gear, wherein the first, second, third, fourth and fifth rotational axes are all radially offset from each other.

6. The toner cartridge of claim 5, wherein the drive coupler of the toner cartridge includes a first set of gear teeth and a second set of gear teeth, the gear teeth of the first drive gear are directly meshed with the first set of gear teeth of the drive coupler of the toner cartridge, and the gear teeth of the first idler gear are directly meshed with the second set of gear teeth of the drive coupler of the toner cartridge.

7. The toner cartridge of claim 6, wherein an outer radius of the first set of gear teeth is greater than an outer radius of the second set of gear teeth.

8. The toner cartridge of claim 6, wherein the second set of gear teeth is positioned axially inward relative to the housing from the first set of gear teeth.

9. A toner cartridge for use in an electrophotographic image forming device, comprising:

a housing having a top, a bottom, a first side and a second side positioned between a first longitudinal end and a second longitudinal end of the housing, the housing has a reservoir for holding toner;

a photoconductive drum rotatably positioned on the housing, a portion of an outer surface of the photoconductive drum is exposed along the bottom of the housing;

a toner adder roll positioned on the housing and rotatable about a first rotational axis;

a developer roll positioned on the housing and rotatable about a second rotational axis, the toner adder roll is positioned to supply toner from the reservoir to the developer roll, the developer roll is positioned to supply toner received from the toner adder roll to the photoconductive drum;

a first drive coupler and a second drive coupler on the first longitudinal end of the housing for mating with a first corresponding drive coupler in the image forming device and a second corresponding drive coupler in the image forming device for receiving rotational motion from the first corresponding drive coupler in the image forming device and the second corresponding drive coupler in the image forming device when the toner cartridge is installed in the image forming device, the first drive coupler of the toner cartridge is rotatably connected to the photoconductive drum and is coaxial with the photoconductive drum, the second drive coupler of the toner cartridge has a third rotational axis, the second drive coupler of the toner cartridge includes a first set of gear teeth and a second set of gear teeth disposed around the third rotational axis, an outer radius of the first set of gear teeth is greater than an outer radius of the second set of gear teeth, the second drive coupler of the toner cartridge is positioned higher than the developer roll and the photoconductive drum;

a first drive gear rotatably connected to the developer roll and coaxial with the developer roll, the first drive gear is positioned on the first longitudinal end of the housing, the first drive gear includes gear teeth disposed around the second rotational axis, the gear teeth of the first drive gear are directly meshed with the first set of gear teeth of the second drive coupler of the toner cartridge;

a second drive gear rotatably connected to the toner adder roll and coaxial with the toner adder roll, the second drive gear is positioned on the first longitudinal end of the housing, the second drive gear includes gear teeth disposed around the first rotational axis; and a first idler gear and a second idler gear each rotatably positioned on the first longitudinal end of the housing and each having respective gear teeth, the gear teeth of the first idler gear are directly meshed with the second set of gear teeth of the second drive coupler of the toner cartridge, and the gear teeth of the second idler gear are directly meshed with the gear teeth of the first idler gear and are directly meshed with the gear teeth of the second drive gear.

10. The toner cartridge of claim 9, wherein the second set of gear teeth is positioned axially inward relative to the housing from the first set of gear teeth such that the second set of gear teeth is positioned closer to the second longitudinal end of the housing than the first set of gear teeth is to the second longitudinal end of the housing.

* * * * *